US005807022A

United States Patent [19]

McCleary

[11] Patent Number: 5,807,022

[45] Date of Patent: Sep. 15, 1998

[54] COMBINATION MORTAR AND GROUT SPREADING DEVICE

[75] Inventor: Michael D. McCleary, Delray Beach, Fla.

[73] Assignee: McCleary Concepts and Creations, Inc., Delray Beach, Fla.

[21] Appl. No.: 698,126

[22] Filed: Aug. 15, 1996

Related U.S. Application Data

[63] Continuation-in-part of Ser. No. 386,737, Feb. 10, 1995, Pat. No. 5,607,256.

[51] Int. Cl.[6] ..... B28B 19/00; E01C 19/48

[52] U.S. Cl. ..... 404/97; 404/101; 404/118; 52/749.11

[58] Field of Search ..... 404/96, 97, 101, 404/105, 108, 118; 118/108, 413; 52/749.1, 749.11

[56] References Cited

U.S. PATENT DOCUMENTS

| | | | |
|---|---|---|---|
| 3,515,041 | 6/1970 | Murtaugh | 404/108 |
| 4,804,321 | 2/1989 | Riesgo | 425/87 |
| 4,917,533 | 4/1990 | Wilson | 404/101 X |
| 5,046,888 | 9/1991 | King | 404/108 X |
| 5,302,051 | 4/1994 | Wilson, Sr. | 404/84.1 |
| 5,387,051 | 2/1995 | Valente | 404/101 X |
| 5,607,256 | 3/1997 | Murtaugh | 404/105 |

*Primary Examiner*—James Lisehora
*Attorney, Agent, or Firm*—Malin, Haley, DiMaggio & Crosby, P.A.

[57] ABSTRACT

An adjustable, combination floor tile mortar and grout spreading device for applying bonding material at a predetermined thickness in a straight-combed manner, and for spreading grout between floor tiles. The device comprises a telescopically adjustable rectangular frame having a leading edge and a trailing edge and a pair of downwardly extending sides for containing bonding material. The rectangular frame is telescopically adjustable to various widths and can be fixed at a particular width depending upon the size tile for the given installation. In the mortar spreading configuration, the trailing edge incorporates a resiliently mounted downwardly extending trowel blade having a conventional trowel blade edge with either a saw-tooth or square-toothed shape. The trowel blade is adjustable such that the device may be used for spreading various thicknesses of bonding material. Bonding material poured onto the subfloor between the frame leading edge and trailing edge is spread by sliding the device across the sub-floor such that the trailing edge trowel spreads the bonding material uniformly. In the grout spreading configuration, the trowel blade is replaced by resiliently mounted first and second grout floats acting as squeegees for spreading grout into the gaps existing between individual tiles.

11 Claims, 13 Drawing Sheets

COMBINATION MORTAR AND GROUT SPREADING DEVICE

This application is a continuation-in-part of Ser. No. 08/386,737, U.S. Pat. No. 5,607,256 filed Feb. 10, 1995.

BACKGROUND OF THE INVENTION

1. Field of the Invention

This invention relates to a combination device for spreading floor tile bonding material and grout, and more particularly this invention relates to an adjustable device for spreading floor tile mortar at a predetermined thickness over a predetermined area of sub-flooring in an efficient, uniform straight combed manner as recommended by the National Tile Contractors Association; the device further being convertable for spreading grout such that the device is capable of filling the spaces between the tiles with grout.

2. Description of the Prior Art

Ceramic flooring tiles are bonded to a variety of subfloors using bonding material including thin set mortar and grout. The term thin set mortar is used to describe the method of installing tiles with bonding material that is usually 3/32 of an inch to 1/8 of an inch in thickness. In other installations, a mortar bed up to two inches in thickness facilitates accurate slopes or planes in finished tile work on floors and walls. Portland Cement Mortar, comprising a mixture of Portland cement and sand, is suitable bonding material for most surfaces in ordinary types of installations.

Portland Cement is the base for most grout and is modified to provide specific qualities such as whiteness, mildew resistance, uniformity, hardness, flexibility and water retentiveness. Non-cement based grouts such as epoxies, furans and silicone rubber offer properties not possible with cement grouts.

Typically, bonding material is spread on an underlying sub-floor using a hand trowel. Hand trowels typically incorporate a trowel blade having serrated edges in the form of a square or sawtooth wave. Trowels are specially sized for spreading a particular thickness of bonding material wherein a larger square wave configuration is used for spreading a thick layer of mortar, and a smaller square wave configuration is used for spreading thinner layers of mortar.

It is very important that the mortar is spread evenly at a predetermined thickness for a given type of ceramic tile for installation. Obtaining an even layer of bonding material requires a high degree of skill on the part of the installer. In addition, because mortar begins to set or cure, the installer typically applies mortar over a relatively small area, subsequently changing over to a tile laying mode and installing the tile over the freshly mortared surface.

Since spreading mortar evenly and efficiently over a subfloor surface is highly important and requires skill, and since frequent changeover from mortar spreading to tile laying is inefficient, a number of devices have been developed to improve the spreading process.

For example, U.S. Pat. No. 5,319,825 issued to Fanning on Jun. 14, 1994, discloses a concrete trowel extension. The extension has a flat upright frame with a pair of handles at the top for operating the frame and a trowel. A trowel is secured to the bottom of the frame by an adjustable clamp. The invention is directed toward a combined system including an extension on a conventional trowel that permits the user to apply pressure more accurately.

U.S. Pat. No. 4,723,869 issued to Dragich on Feb. 9, 1988, discloses a long-handled trowel with adjustable weights. The invention includes a trowel having a blade assembly, a reinforcing rib base mounted on the trowel's upper surface, and a handle pivotally connected at one end portion to the blade assembly such that an operator can move the blade member over the surface from a remote location. In addition, the invention contemplates adjustable weights which can be selected, added to or taken away from the blade assembly to vary the effective weight of the trowel. In this invention, the adjustable weights do not adversely affect the flexibility of the trowel blade proximate its edge portion such that a flexible blade serves to enhance the smoothness of the surface produced by the device.

Furthermore, floor tiles are typically installed in spaced relation such that a gap exists between adjacent tiles. While gap size varies depending upon the installation, 1/8 inch to 3/4 inch gaps are typical. After the tiles are set and bonded by the mortar, grout must be applied in a squeegee like manner such that these gaps are filled.

Thus, there still exists a need for a combination mortar and grout spreader having an adjustable trowel for spreading mortar over a sub-floor for efficiently spreading a large quantity of mortar in a single pass, and also used for filling the spaces between the tiles with grout.

In each of the prior art devices, however, pressure applied by the user on the trowel handle may adversely affect pressure on the trowel blade resulting in uneven spreading.

A further disadvantage with the prior art trowels is that the user must first provide a supply of mortar, typically by scooping the mortar using a hand trowel or other device from a bucket and then smoothing the mortar using the trowel. Therefore, should the user apply too much bonding material for a given area, the bed may be too thick. On the other hand, should the user not apply enough bonding material, the resulting bed may be too thin. Furthermore, should the user apply the bonding material by applying uneven pressure, the bed may be uneven. Thus there still exists a need for an automatic spreader wherein a measured quantity of bonding material may be placed for automatic distribution across the underlying sub-floor.

SUMMARY OF THE INVENTION

The instant invention is designed to overcome the aforementioned disadvantages present in the prior art. The invention contemplates an adjustable, mortar and grout spreading device for applying tile bonding material at a predetermined thickness in an efficient manner and for applying grout for filling tile gaps.

The device comprises a telescopically adjustable rectangular frame having a leading end and a trailing end and a pair of downwardly extending sides, terminating in scratch resistant plastic skids, for containing mortar and grout. The rectangular frame is telescopically adjustable between 24" and 40" in width and can be fixed at a particular width depending upon the size tile for the given installation. Although the specific widths referenced above are preferred, any suitable range of widths is within the scope of the invention. In the first mode of operation, the frame end incorporates a detachable, downwardly extending trowel blade having a conventional trowel blade edge such as a saw-tooth or square-toothed shape. The trowel blade is adjustable in height, and is also removably attached proximate the trailing end such that the device may be used for spreading various thicknesses of mortar either by vertically adjusting the trowel blade or by attaching a trowel blade with a different trowel blade tooth/notch size. A significant feature of the invention provides that the trowel blade is resiliently mounted and downwardly biased urging the blade edge in contact with the sub-floor.

Once the tile is installed and allowed to set, the trowel blade may be replaced with a one or more downwardly extending grout floats, each float having a squeegee like edge for applying grout between the tiles. In the preferred embodiment a leading grout float extends downwardly and is inclined toward the trailing end of the frame for forcing grout into the tile joints, and a trailing grout float is substantially vertical for removing excess grout from the tile joints and tile surface. Both grout floats are resiliently mounted to the frame and downwardly biased for maintaining constant pressure while grouting.

To use the device, the tile installer sets the width, for example, just over thirty-six inches for accommodating a row of three twelve inch tiles, pours a supply of mortar onto the underlying sub-floor in the middle of the rectangular frame, and proceeds to drag the device such that the trailing end of the device incorporating the downwardly extending trowel blade rakes and levels the mortar to a particular thickness. Weights, consisting of spare flooring tiles or bricks are placed on the trailing end corners of the frame to insure adequate pressure on the underlying trowel blade. Further, rope may be attached to the frame leading end for enabling the user to easily drag the device across the sub-floor. Therefore, the device allows for spreading a raked layer of mortar at a predetermined thickness over a relatively large area in a single pass.

Once the mortar layer is applied and floor tiles are installed and allowed to set, the device is converted to a grout spreader by replacing the trowel blade with at least one grout float for smoothing grout into the spaces between the tiles. A second grout float or sponge like squeegee is installed at the trailing end of the device for removing excess grout from the surface of the floor tiles. Preferably a pair of grout floats are attached in parallel; the leading grout float extending downwardly at an angle toward the trailing end of the device, and the trailing grout float extending substantially vertically downward.

It is an object of the present invention to provide an improved tile mortar spreading device for applying floor tile mortar, such as thin set mortar, to an underlying sub-floor.

Another object of the present invention is to provide an adjustable bonding material spreading device whereby a supply of bonding material may be evenly applied to a sub-floor by filling the device with the desired quantity of bonding material and dragging the device across the sub-floor.

Still another object of the instant invention is to provide an adjustable bonding material spreading device capable of spreading bonding material across a user selected width of subflooring.

Yet another object of the instant invention is to provide a spreading device that may be converted for applying grout in the gaps existing between the installed tiles.

A further object of the instant invention is to provide a bonding material spreading device that collapses for convenient handling and storage.

In accordance with these and other objects which will become apparent hereinafter, the instant invention will now be described with particular reference to the accompanying drawings.

DESCRIPTION OF THE PREFERRED EMBODIMENTS

Figure 1:
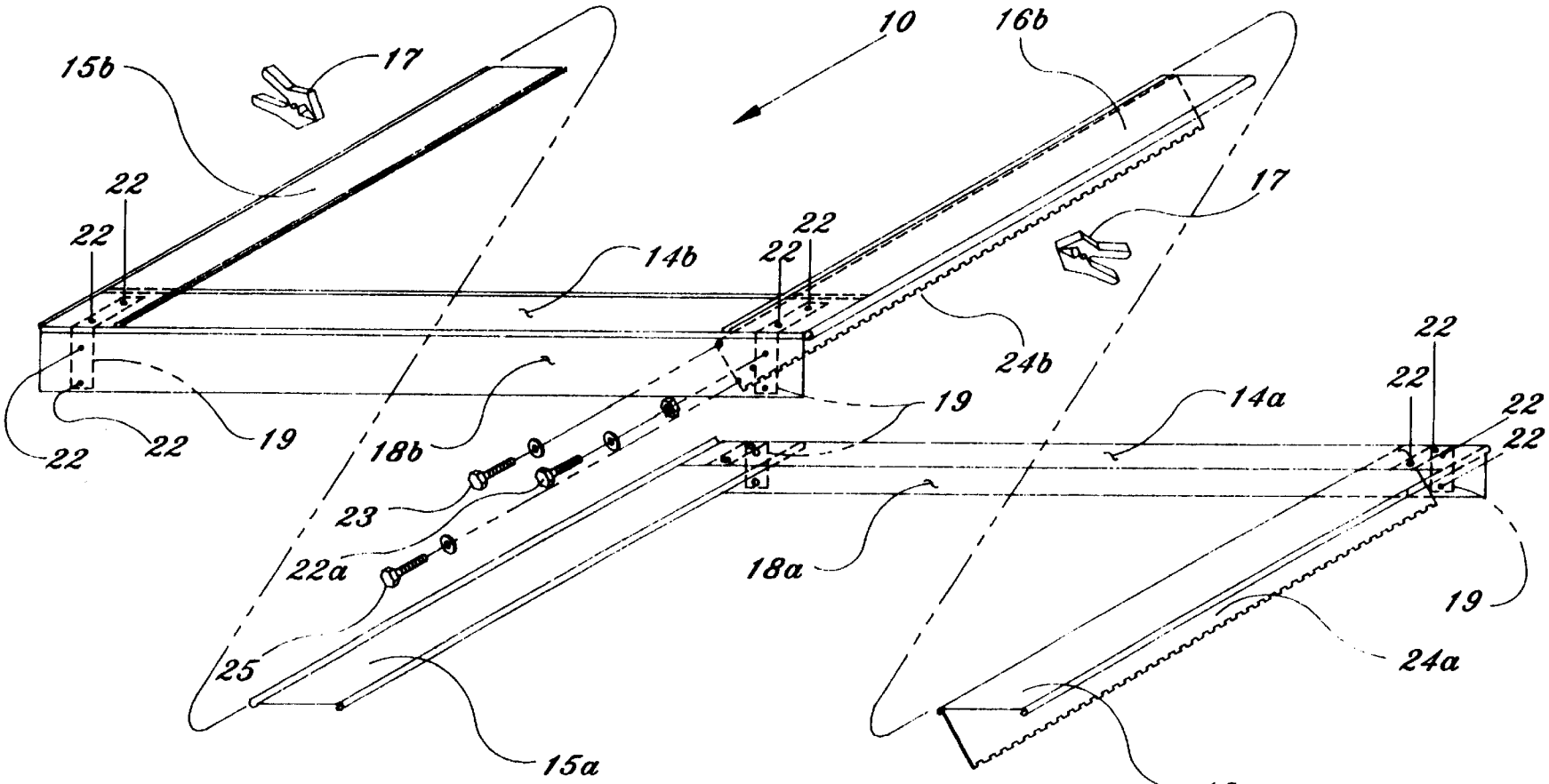
FIG. 1 is an exploded view of a first embodiment of the instant device.
Figure 2:
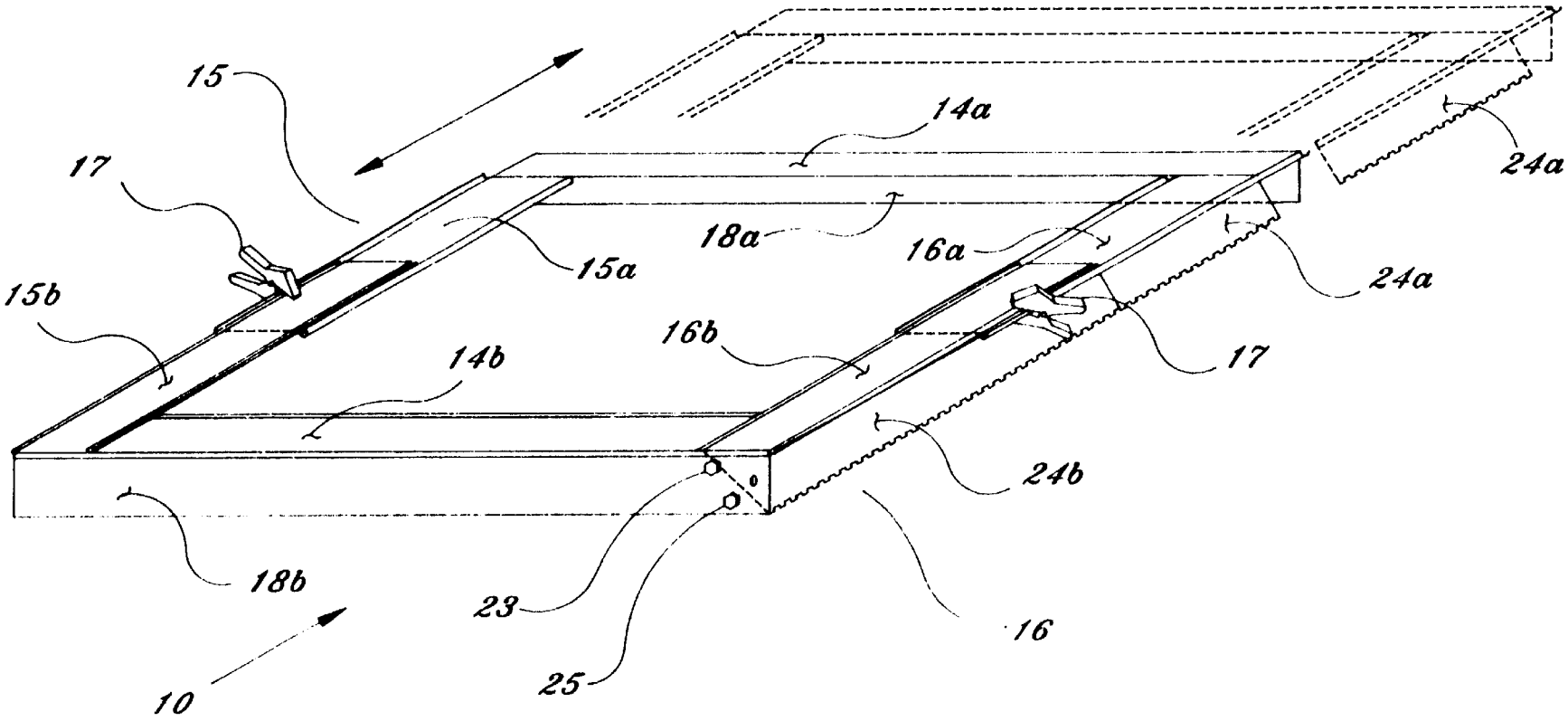
FIG. 2 is a perspective view of a first embodiment of the instant device illustrating telescopic adjustment.

Referring now to the drawings, FIGS. 1–12 depict the adjustable, spreading device for applying floor tile mortar and grout, generally designated by reference numeral 10. The device includes a rectangular frame formed by a pair of telescopically adjustable U-shaped sections 14*a* and 14*b* respectively. Each U-shaped section, 14*a* and 14*b*, has a pair of extending arms 15*a* and 16*a*, and 15*b* and 16*b* respectively, in overlapping telescoping engagement such that the width of the frame may be adjusted by the user as illustrated in FIG. 2.

Figure 4:
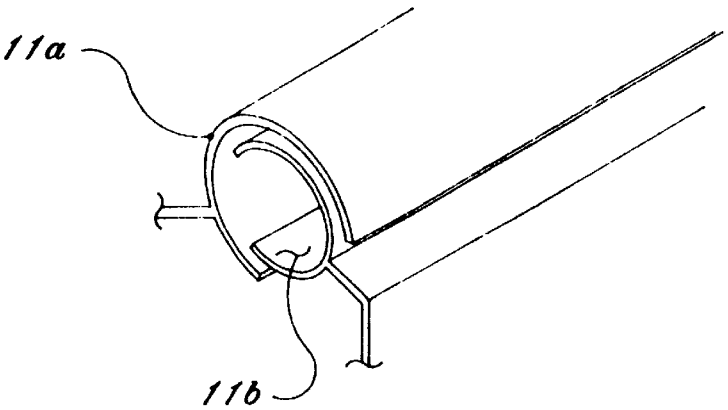
FIG. 4 is a detail of an embodiment of the interlocking assembly that allows for slidable engagement.

In a preferred embodiment, the frame is formed by inter-locking aluminum structural components, reinforced by L-shaped reinforcing members 19 having apertures 22 therein and being secured at the frame corners by conventional fasteners 22*a*. Each aluminum structural component incorporates a formed edge 11*a* and 11*b*, respectively, for inter-locking with the formed edge of a cooperating component as best seen in FIG. 4. Thus extending arms 15*a* and 15*b*, and 16*a* and 16*b*, are slidably engaged by cooperating, inter-locking edges. Thus, the rectangular frame is telescopically adjustable to various widths and can be fixed at a selected width by using clamps 17, or any suitable means.

The frame further incorporates downwardly extending opposing sides 18*a* and 18*b*. Sides 18*a* and 18*b* function to contain bonding material while serving as skids for sliding the device across a subfloor, as will soon become apparent. Sides 18*a* and 18*b* may terminate in plastic coated skid edges to prevent scratching of the underlying surface, a feature particularly desirable when the device is used for spreading grout between the gaps of installed tiles.

Figure 3:
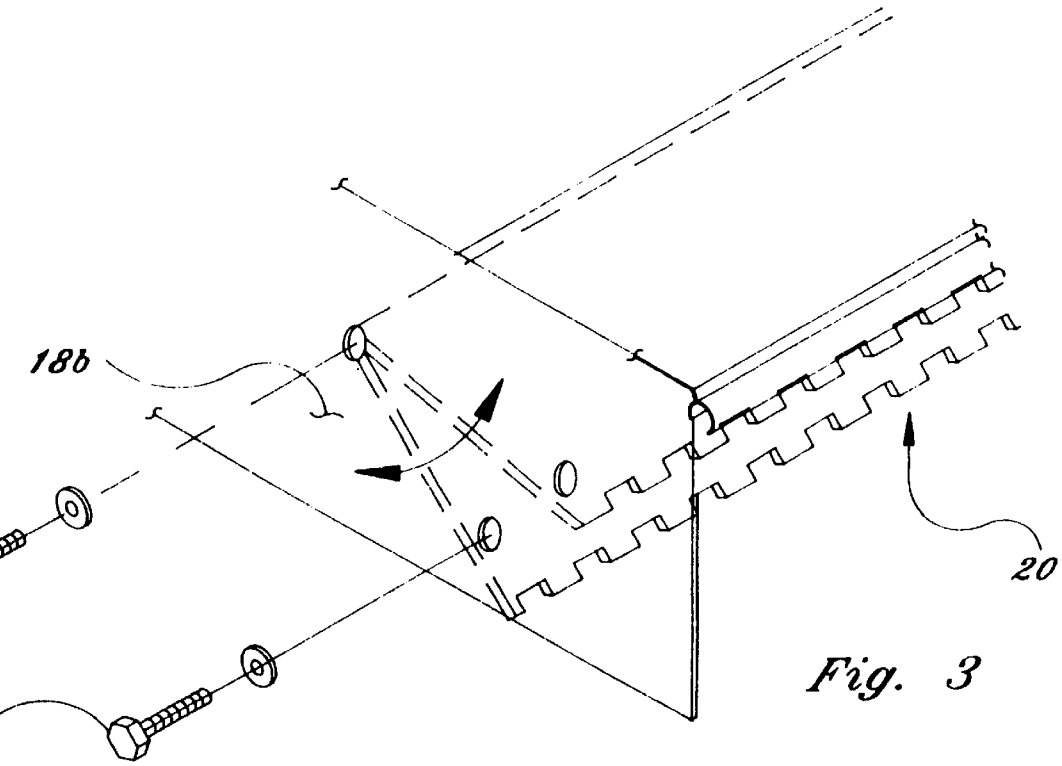
FIG. 3 is a detail of a first embodiment of the trowel blade adjustment assembly.
Figures 11, 12:
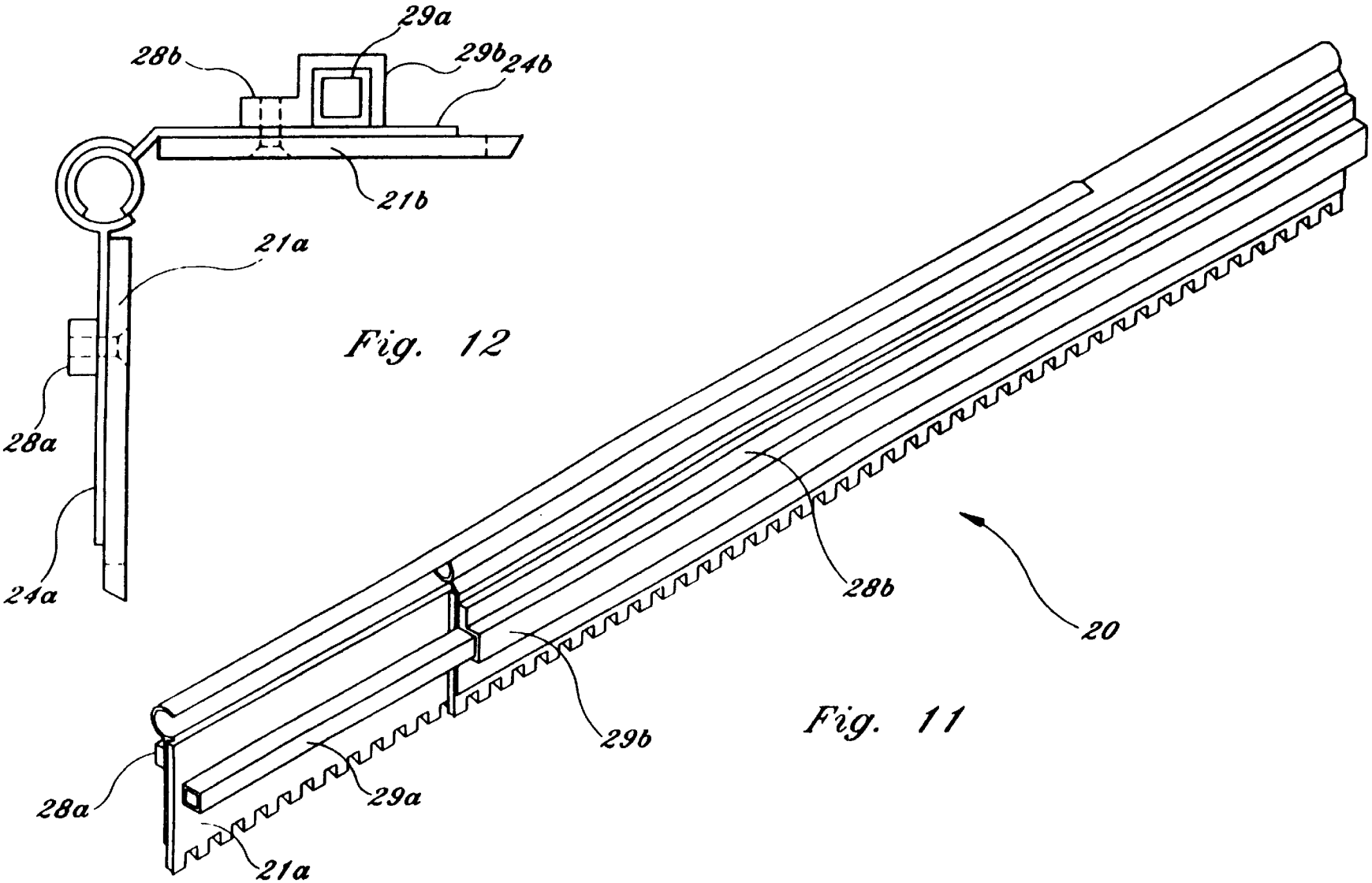
FIG. 11 is a perspective view of an embodiment of the spreading bar assembly.
FIG. 12 is a side elevational view of an embodiment of the spreading bar assembly.

Telescoping arms 15*a* and 15*b* form a leading end 15 of the device 10, while arms 16*a* and 16*b* form the trailing end 16 of the device for reasons that will soon become apparent. A telescoping spreading bar assembly, generally designated by reference numeral 20, is movably secured proximate said device trailing end, extending downwardly beneath arms 16*a* and 16*b*. Spreading bar assembly 20 includes a spreading bar comprising spreading bar sections 24*a* and 24*b* as best depicted in FIGS. 11 and 12. Spreading bar sections 24*a* and 24*b* are each pivotally secured at one end to sides 18*a* and 18*b* respectively by fasteners 23 as seen in FIGS. 1 and 2. For clarity, only trowel blade sections 21a and 21*b* are shown in FIGS. 1–3 and 5–7. It should be understood however that in the preferred embodiment the entire spreading bar assembly as depicted in FIGS. 11 and 12 is to be utilized to add strength to trowel blade sections 21*a* and 21*b*. However, in an alternate embodiment, it is contemplated that the trowel blade may be utilized without the need for the entire spreading bar assembly, such as having a spreading bar with trowel blade teeth disposed on a lower edge thereon as seen in FIGS. 1–3. Opposing spreading bar section ends are slidably engaged with one another such that spreading bar 20 expands and contracts telescopically in unison with arms 16*a* and 16*b*.

As best depicted in FIGS. 11 and 12, spreading bar assembly 20 has a telescoping trowel blade comprising telescoping trowel blade sections 21*a* and 21*b* attached thereto. Trowel blade sections 21*a* and 21*b* are each adjustable in height and are removably attached to spreading bar sections 24*a* and 24*b*, respectively. A reinforcing bar comprising reinforcing bar sections 28*a* and 28*b* are attached to spreading bar sections 24*a* and 24*b*, respectively, and in the preferred embodiment are threaded to allow the attachment of removable trowel blade sections 21*a* and 21*b* to spreading bar sections 24*a* and 24*b*. A telescoping stabilizer bar comprising telescoping stabilizing bar sections 29*a* and 29*b* are disposed on the outer surface of spreading bar sections 24*a* and 24*b*, respectively, thereby preventing spreading bar assembly 20 from bowing when the device 10 is in use. The trowel blade sections 21*a* and 21*b* are adjustable in height such that the device 10 is used for spreading various thicknesses of mortar. Further, a variety of trowel blade tooth sizes (e.g. ¼ in.×¼ in., ½ in.×½ in., ¼ in.×⅜ in., etc.) may be used by the installer depending upon the thickness of mortar layer desired.

As best depicted in FIG. 3, telescoping trowel blade sections 21*a* and 21*b* each terminate in a lower edge having a square-toothed configuration. However, it is contemplated that any conventional trowel blade configuration (e.g. square-toothed, saw-toothed, etc.) may be utilized. Spreading bar assembly 20 is pivotally adjustable, as seen in FIG. 3, such that the height of the lower trowel blade edge above the sub-floor may be adjusted by the user for spreading the desired thickness mortar bed. If a thin layer of bonding material (e.g. mortar) is desired, spreading bar assembly 20 is pivoted downward and secured by an anchoring pin 25. If, on the other hand, a thicker layer of bonding material is desired, spreading bar assembly 20 is pivoted upward such that the blade edge is raised higher above the sub-floor, and secured by anchoring pin 25.

Figure 5:
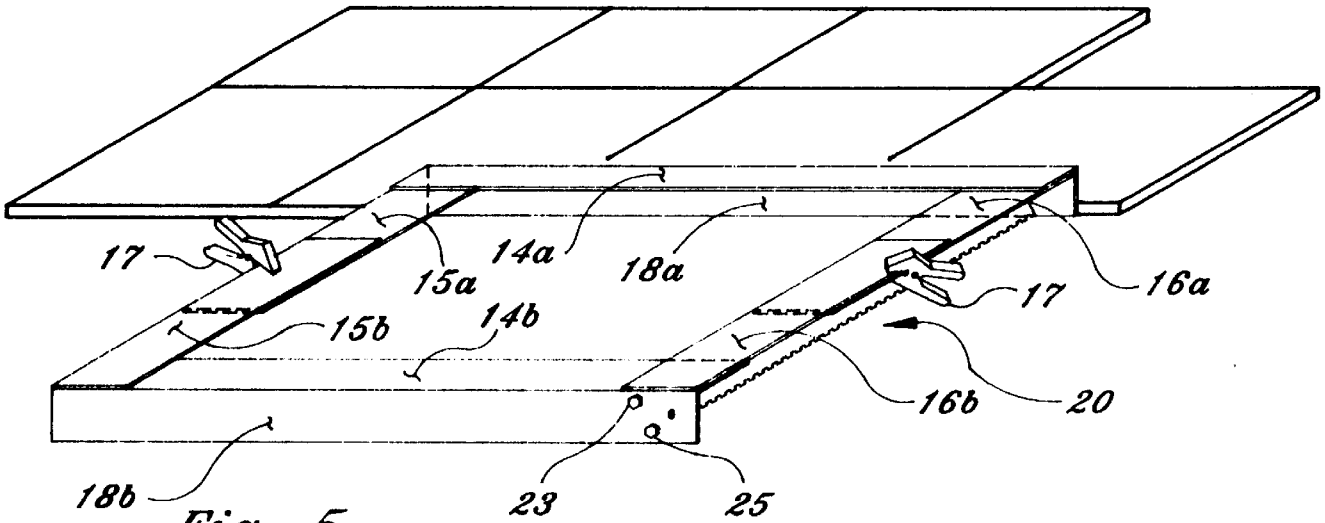
FIG. 5 illustrates a first embodiment of the mortar spreading device on a subfloor.

To use the device, the user adjusts the frame to a width, depending on the size of the tiles and the amount of bonding material desired, by removing clamps 17 and expanding or contracting U-shaped sections 14*a* and 14*b* such that arms 15*a*, 15*b*, 16*a*, 16*b*, and spreading bar assembly 20 telescopically expand or contract. The user then fixes the device at the desired width by anchoring arms 15*a* and 15*b*, and 16*a* and 16*b* with clamps 17. In the preferred embodiment, the width is adjustable between twenty four and forty eight inches, however other widths are contemplated. For example, the installer may adjust the width to just over 36 inches for spreading bonding material for laying rows of three twelve inch tiles. The device 10 is then placed on the sub-floor at a desired location such that the spreading bar assembly 20 is positioned at the desired starting point for a new mortar layer, as best illustrated in FIG. 5.

Figure 7:
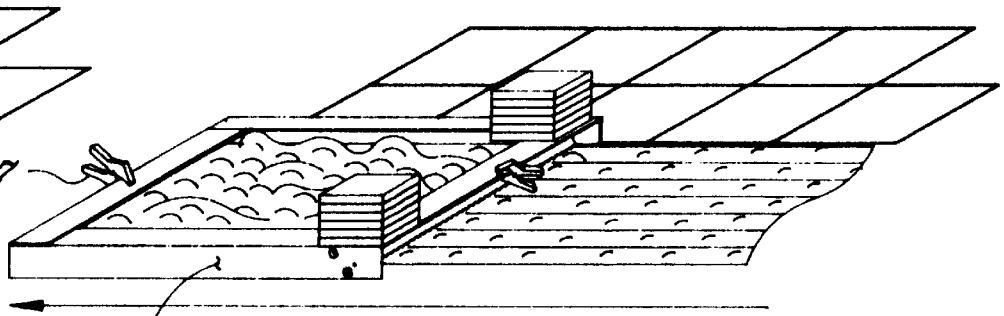
FIG. 7 illustrates a first embodiment of the mortar spreading device moved along the supporting sub-floor leaving a straight combed layer of mortar in its wake.
Figure 6:
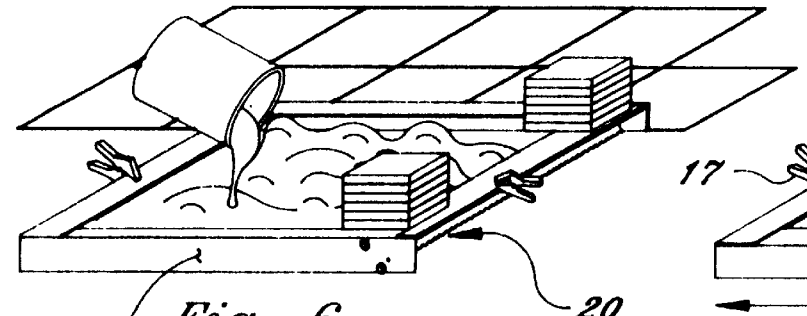
FIG. 6 illustrates a first embodiment of the mortar spreading device filled with a supply of mortar.

Next, as best illustrated in FIG. 6, the user mixes, or otherwise obtains, the proper mortar mixture such as thin set mortar, and pours the mortar (e.g. the device is capable of holding at least a five gallon bucket of mortar) directly onto the subfloor area framed by the device 10 such that, when poured, the material is confined by the device's opposing sides 18*a* and 18*b* and the spreading bar assembly 20. In addition, weight is added to maintain the spreading bar assembly 20 at the proper height by placing weighted objects, such as spare floor tiles, on the frame's corners as seen in FIGS. 6 and 7. The user then slides the device 10 in the direction indicated by the arrow in FIG. 7, causing trowel blade sections 21*a* and 21*b* to pass over the mortar bonding material thereby spreading a bonding material layer of uniform thickness in its wake. Therefore, the device allows for spreading a uniform layer of mortar at a predetermined thickness over a relatively large area in a single pass.

Figure 8:
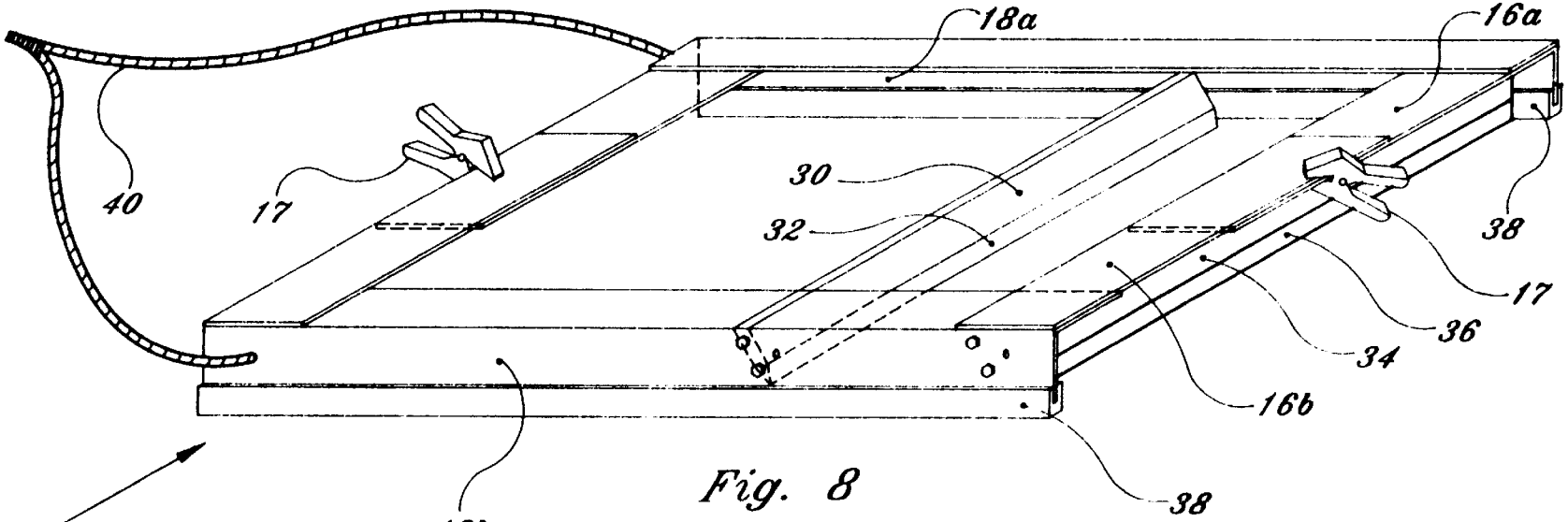
FIG. 8 illustrates a first embodiment of the instant device wherein the device has been converted into a grout spreader.
Figure 10:
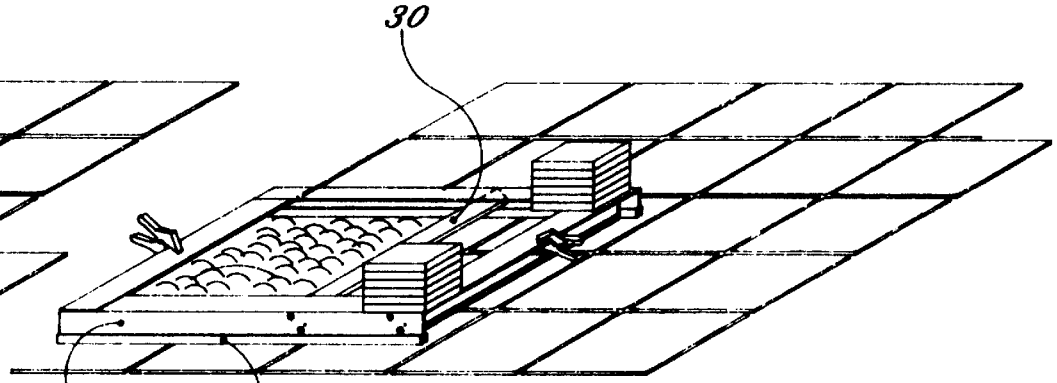
FIG. 10 illustrates a first embodiment of the grout spreading device of FIGS. 8 and 9 moved along the tile surface.
Figure 9:
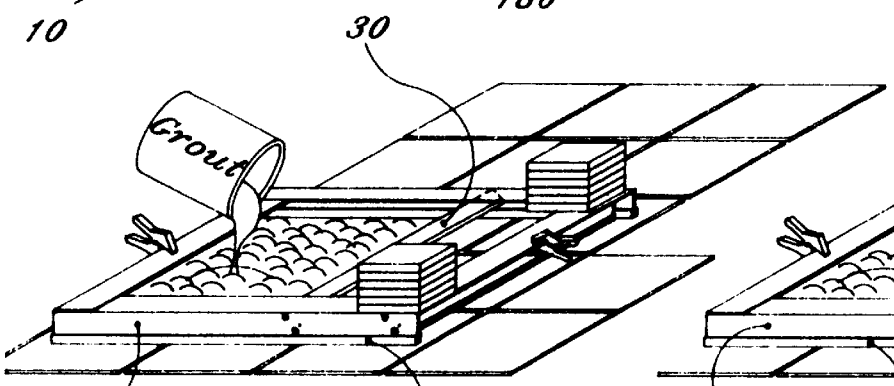
FIG. 9 illustrates a first embodiment of the instant device of FIG. 8 filled with a supply of grout.

As seen in FIGS. 8–10, once a layer of mortar is spread and tiles are installed thereon, the device 10 is converted to a grout spreader wherein the trowel blade sections 21*a* and 21*b* are removed from spreading bar assembly 20 and a downwardly extending grout float 30, having a rubber-like straight edge 32, is installed. In addition, a second downwardly extending grout float 34, having a rubber-like straight edge 36 is installed. Secondary grout float 34 acts as a squeegee and is attached to the trailing end for removing excess grout from the flooring tile surface. Secondary grout float 34 is attached to the frame by reconfiguring arms 16a and 16*b* to a vertical configuration such that the lower edge 36, equipped with a rubber-like squeegee, contacts the underlying tile surface for removing excess grout.

In the grout spreading mode the device 10 is positioned over the previously installed flooring tile and a suitable amount of grout is poured in the middle of the frame such that the grout is contained by opposing frame side walls 18*a* and 18*b* and grout float 30. Once again weights are placed on the trailing end corners and the device is dragged across the flooring tile by the user. Rope 40 may be attached to the frame leading end for enabling the user to easily drag the device across the tile. As the device 10 slides across the underlying tile, the plastic coated skids 38 prevent scratching. In addition, grout float 30 forces grout into the gaps existing between the tiles and the trailing end grout float 34 acts as a squeegee and removes excess grout from the tile gaps and the tile surface thereby completing the grouting process.

ALTERNATE EMBODIMENT

Figure 13:
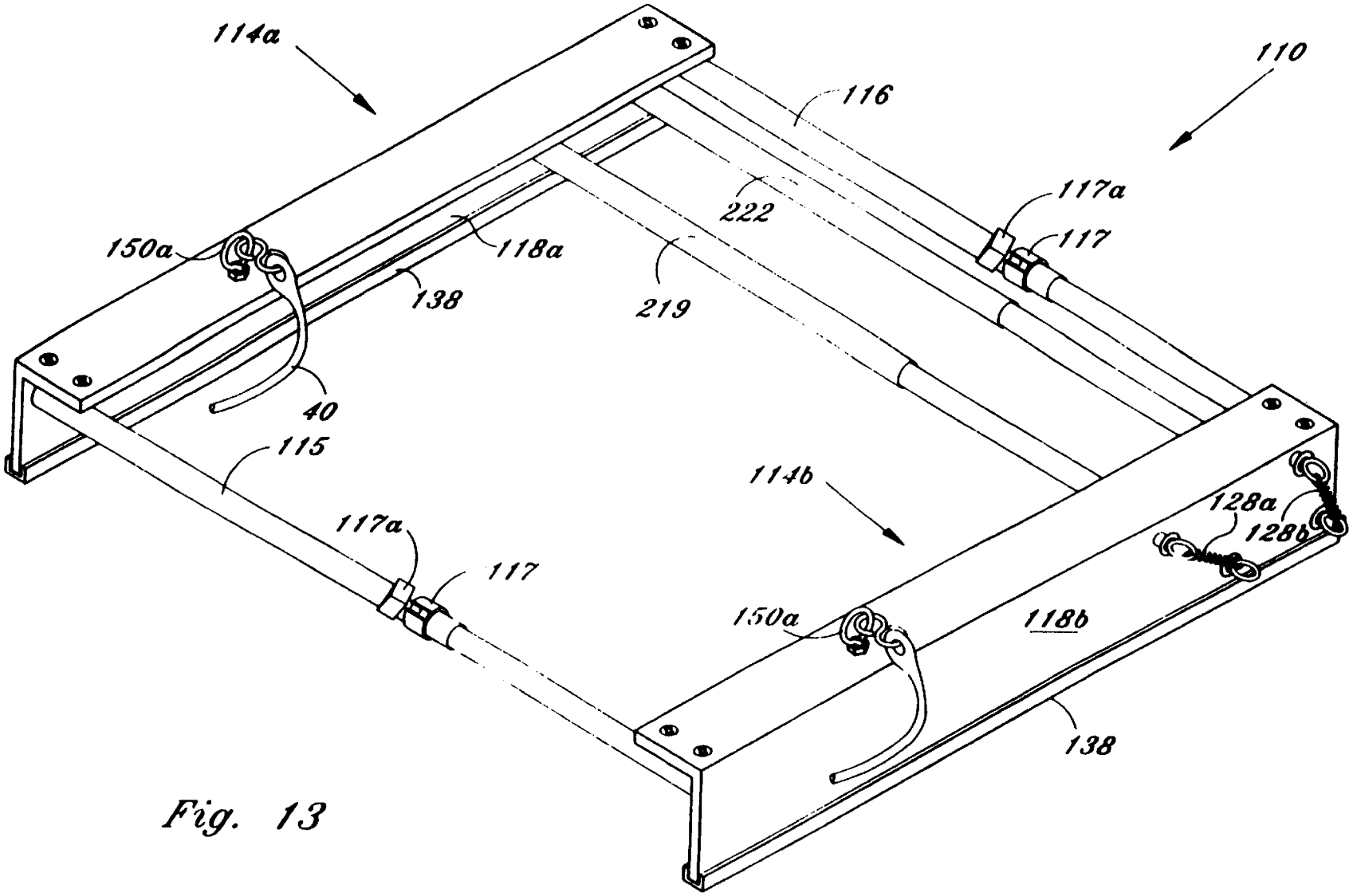
FIG. 13 is a perspective view of an improved alternate embodiment of the adjustable frame of instant invention without mortar blades or grout floats attached.
Figure 14:
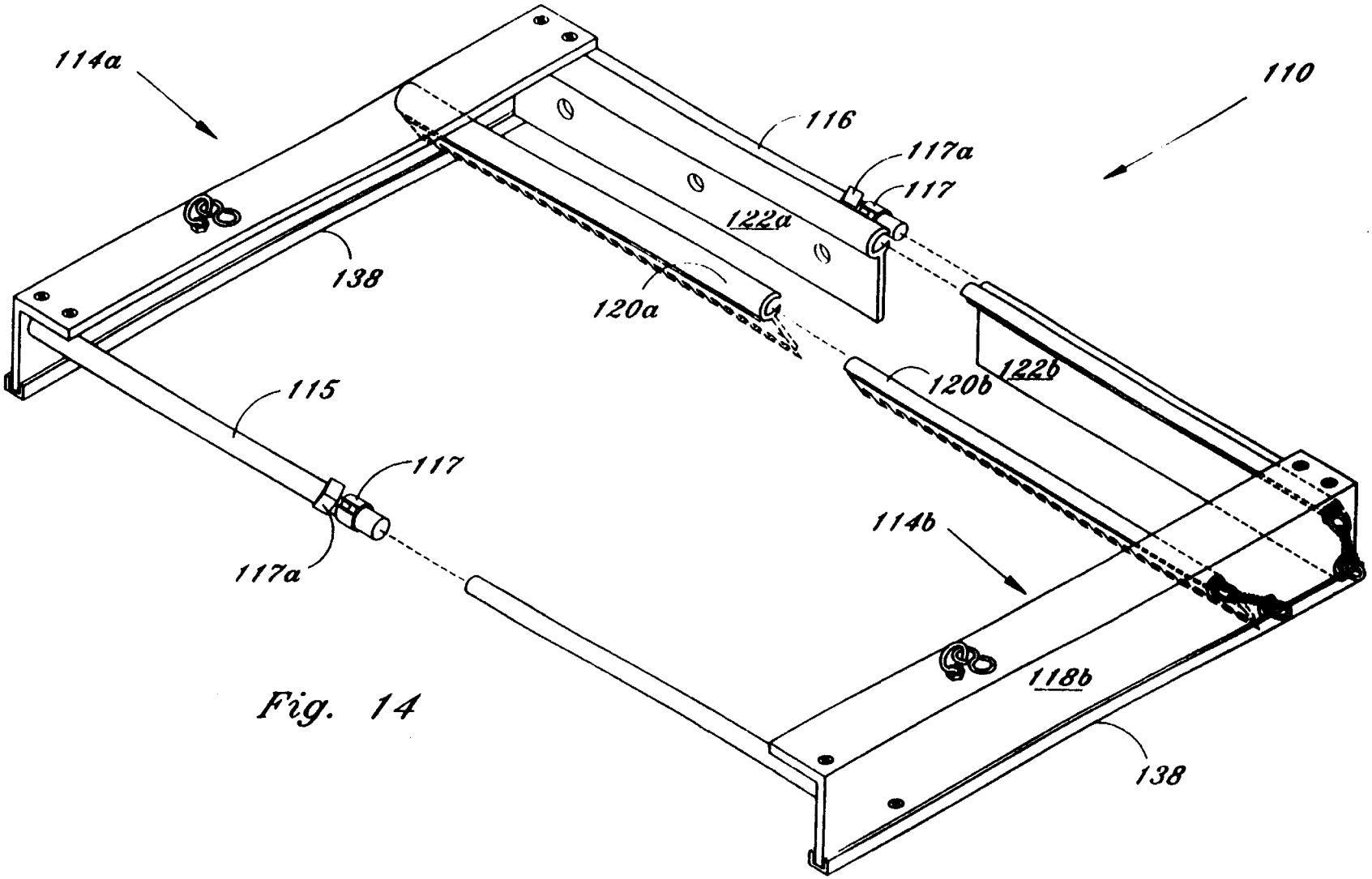
FIG. 14 is an exploded perspective view of the improved alternate embodiment of the instant invention with a notched spreading blade attached.

Referring now to the drawings, FIGS. 13–21 there is depicted a preferred alternate embodiment of the adjustable, spreading device for applying floor tile mortar and grout, generally designated by reference numeral 110. The device includes a frame formed by a pair of telescopically adjustable sections 114*a* and 114*b* respectively. Sections 114*a* and 114*b*, are joined by a pair of telescoping members 115 and 116, such that the width of the frame may be adjusted by the user as illustrated in FIGS. 13 and 14.

In the preferred embodiment, sections 114*a* and 114*b* are formed by aluminum structural components which form opposing frame side walls 118*a* and 118*b*. Aluminum structural components 114*a* and 114*b* are each attached to opposing ends of telescoping members 115 and 116 by a suitable fastening means as best depicted in FIG. 13. Telescoping members 115 and 116 each include means for anchoring each member at a user determined length. In the preferred embodiment telescoping members 115 and 116 each comprise a pair of aluminum tubing members in sliding telescopic engagement, and the means for anchoring comprises a collar 117 having a locking thumb screw 117*a* for securing telescoping members 115 and 116 at a user selected length thereby spacing frame walls 118*a* and 118*b* at a width selected by the user.

As is now apparent, the rectangular frame is telescopically adjustable to various widths and can be fixed at any selected width by anchoring means 117, thereby positioning frame sides 118*a* and 118*b* in parallel spaced relation at precise user selected distance relative to one another. While frame sides 118*a* and 118*b* are parallel in this preferred embodiment it is contemplated that any non-parallel arrangement is an equivalent and may be desirable.

Sides 118*a* and 11*b* function to contain bonding material while having bottom edges serving as skids for sliding the device across a subfloor, as will soon become apparent. Sides 118*a* and 118*b* may be fitted with skids 138 to prevent scratching of the underlying surface, a feature particularly desirable when the device is used for spreading grout between the gaps of installed tiles. Skids 138 may be fabricated from plastic, nylon, or any other suitable material.

Telescoping member 115 is disposed proximate the leading end of the device 110, while telescoping member 116 is disposed proximate the trailing end of the device. An additional pair of telescoping members 219 and 222 are also attached to the lower portion of the frame proximate skids 138, for reasons which will soon become apparent.

Figure 20:
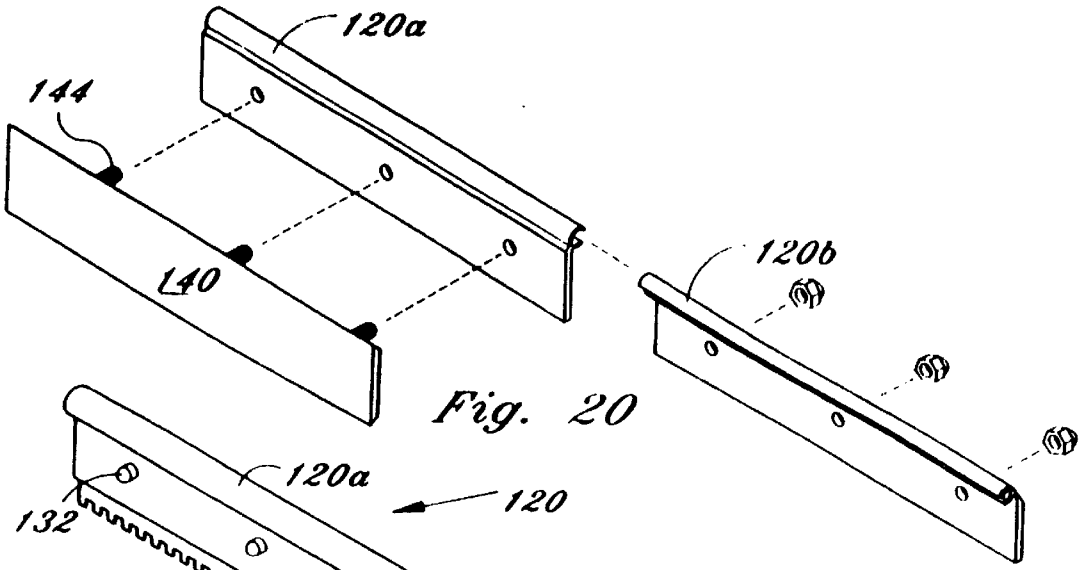
FIG. 20 is an exploded view of the grout float attachment and the telescopic mounting plates.
Figure 21A:
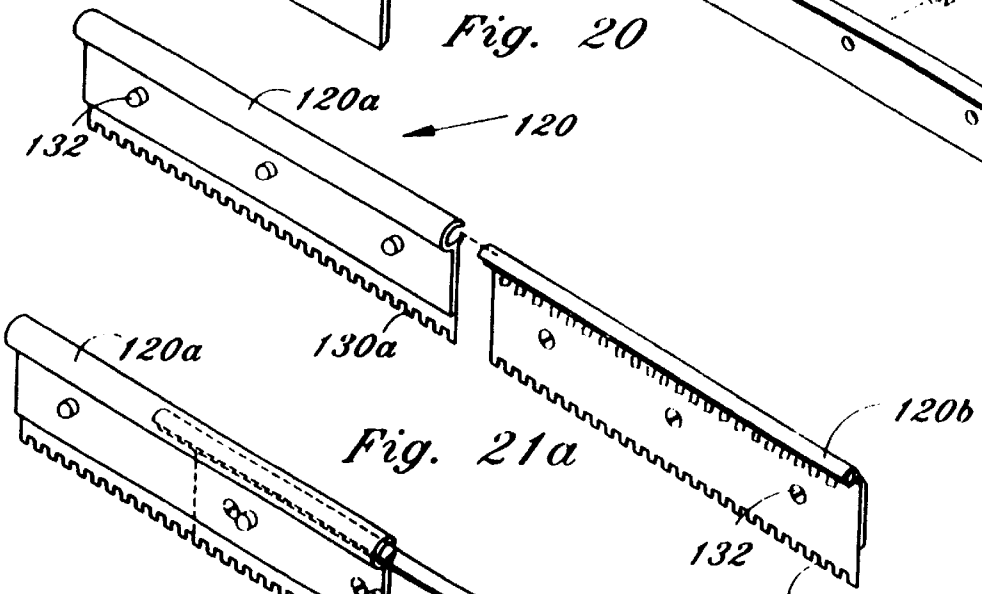
FIG. 21*a* is an exploded view of the telescopic mounting plates each having notched trowel blades attached.
Figure 21B:
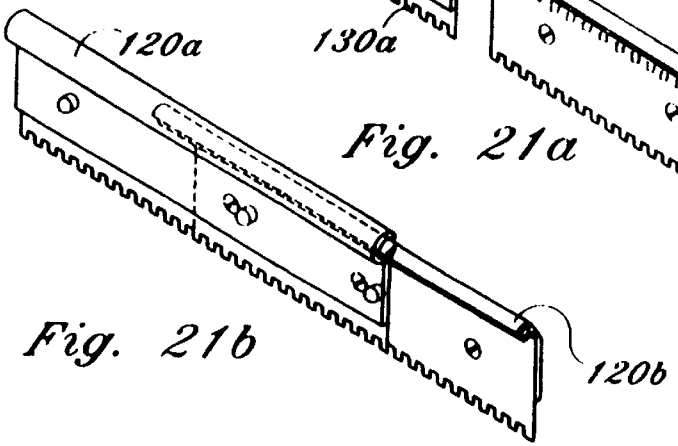
FIG. 21*b* is a view of the telescopic mounting plates each having notched trowel blades attached.

The device further includes a pair of telescoping hardware mounting means comprising mounting plate assemblies, generally designated by reference numerals 120 (leading) and 122 (trailing), as best depicted in FIGS. 20, 21*a* and 21*b*, secured at opposing ends to frame sides 118*a* and 118*b*. Each mounting plate assembly 120 and 122 include a pair of overlapping mounting plates 120*a*, 120*b*, and 122*a*, 122*b*, respectively. Each telescopic mounting plate assembly incorporates a pair of flat plate components having interlocked formed top edges 11*a* and 11*b* as depicted in FIG. 4, such that each pair of flat plate components are in telescopic overlapping engagement. Each mounting plate assembly functions as a mounting structure for spreading hardware such as trowel blades and/or grout floats for reasons which will soon become apparent.

Figure 15:
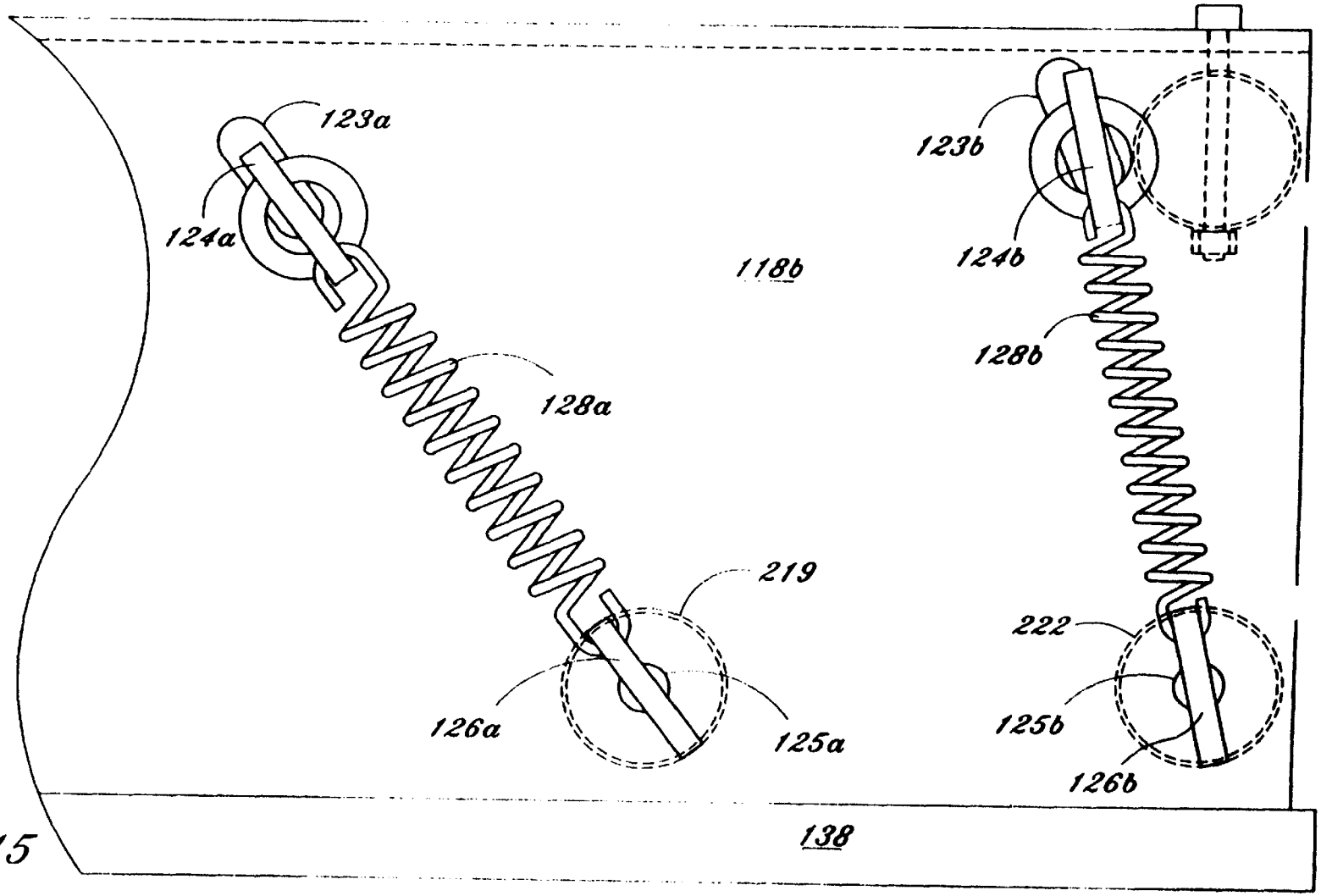
FIG. 15 is a partial side view of the improved alternate embodiment of the instant invention.
Figure 16:
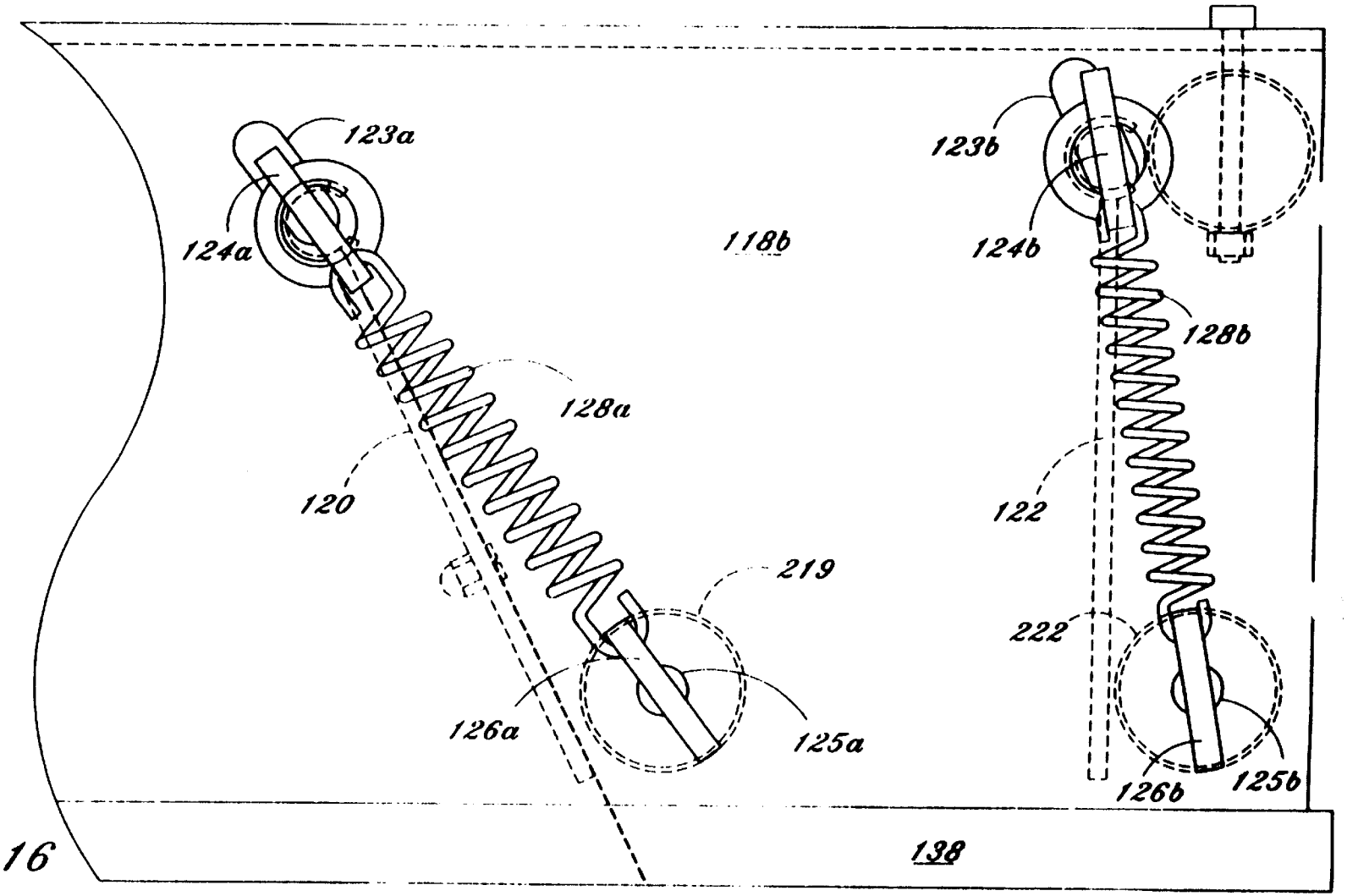
FIG. 16 is a partial side view of the improved alternate embodiment of the instant invention with a notched spreading blade attached.

As best depicted in FIGS. 15 and 16, frame sides 118*a* and 118*b* each incorporate a apertures 123*a*, 123*b*, 125*a*, and 125*b*. Apertures 123*a* and 123*b* are slotted and function as fastening apertures for fastening opposing ends of mounting plate assemblies 120 and 122 to frame sides 118*a* and 118*b*. Apertures 125*a* and 125*b* function as fastening apertures for telescoping members 219 and 222. Suitable fasteners such as eyebolts fasteners are used for fastening mounting plates 120 and 122, and for fastening telescoping members 219 and 222, to frame sides 118*a* and 118*b*, as best depicted in FIGS. 15 and 16. Eyebolts 124*a* and 124*b* fasten mounting plate 120 and 122 respectively, and eyebolts 126*a* and 126*b* fasten telescoping members 219 and 222. In addition, eyebolts 124*a* and 126*a* are resiliently connected by helical spring 128*a*, while eyebolts 124*b* and 126*b* are connected by helical spring 128*b*. As is now apparent, sides 114*a* and 114*b* of the device are each identically configured, as detailedly depicted in FIGS. 15 and 16 (with respect to side 118*b*) and mounting assemblies 120 and 122 are generally downwardly biased by the disclosed slotted mounting configuration and springs 128. The ability to downwardly bias mounting assemblies 120 and 122 is an important aspect of the instant invention.

As is now apparent, mounting plates 120 and 122 provide means for mounting additional hardware. For example, as best depicted in FIGS. 14, 16, 20 and 21*a–b*, specially constructed trowel blades and grout floats may be removably mounted thereon. The trowel blades are fabricated with a plurality of centrally disposed mounting apertures and opposing notched sides such that the blades can be reversed as the notches on one side wear. In addition, it is contemplated that the notches on opposing sides may be of differing size such that the user is able to simply flip the blades for specific applications. FIG. 21*a* depicts the mounting of trowel blades 130*a* and 130*b* on mounting assembly 120 using fasteners 132. Trowel blades 130*a* and 130*b* have notches on two opposing sides. FIG. 21*b* depicts the mounting assembly 120 telescopically configured with trowel blades 130*a* and 130*b* mounted thereon. As is best depicted in FIG. 16, mounting assembly 120 having trowel blades mounted thereon is pivotally secured by eyebolt 124*a* and downwardly biased, in slotted aperture 123*a*, by spring 128*a* for maintaining the notched edge of the trowel blade in contact with an underlying sub-floor. As is now apparent, the mounted trowel blades are maintained at an optimal angle by telescopic member 219 which functions as a supporting stop.

As best depicted in FIGS. 21*a* and 21*b*, telescoping trowel blade sections 130*a* and 130 *b* each terminate in a lower edge having a square-tooth configuration. However, it is contemplated that any conventional trowel blade configuration (e.g. square-tooth, saw-tooth, etc.) may be utilized.It is contemplated that a variety of trowel blade tooth sizes (e.g. ¼ in.×¼ in., ½ in.×½ in., ¼ in.×⅜ in., etc.) may be used by the installer depending upon the thickness of mortar layer desired.

a. Spreading Mortar

To use the device for spreading mortar, the user first installs trowel blades 130*a* and 130*b* and adjusts the frame to a width, depending on the size of the tiles and the amount of bonding material desired, by loosening telescopic anchoring means 117 and 117*a* on telescopic members 115 and 116 (note that telescopic members 219 and 222 are not anchored), and telescopically expanding or contracting the frame, such that members 115, 116, 219 and 222, telescopically expand or contract, until sides 118*a* and 118*b* are spaced a suitable distance apart, after which the user locks the frame by tightening telescopic anchoring means 117 on members 115 and 116.

In the preferred embodiment, the width is adjustable between twenty four and forty eight inches, however other widths are contemplated. For example, the installer may adjust the width to just over 36 inches for spreading bonding material for laying rows of three twelve inch tiles.

Since trowel blades 130*a* and 130*b* at least partially overlap, the user must anchor the frame such that the notches on each blade are aligned in phase so as to provide an uninterrupted notched edge for spreading mortar. When used to spread mortar trowel blades are preferably mounted on the leading mounting plates 120, and it is generally not necessary to mount additional trowel blades on trailing mounting plates 122. The device may then be used for spreading mortar as previously described and as depicted in FIGS. 6 and 7. It is important to note that springs 128*a* on each side of the frame maintain the notched edge of the trowel blade in constant contact with the underlying subfloor, notwithstanding wear experienced by the blade edge or unevenness in the subfloor.

b. Spreading Grout

Figure 19A:
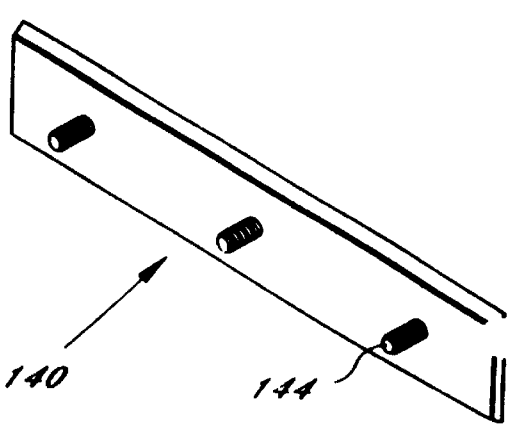
FIG. 19*a* is a perspective rear view of the grout float attachment of the present invention.
Figure 19B:
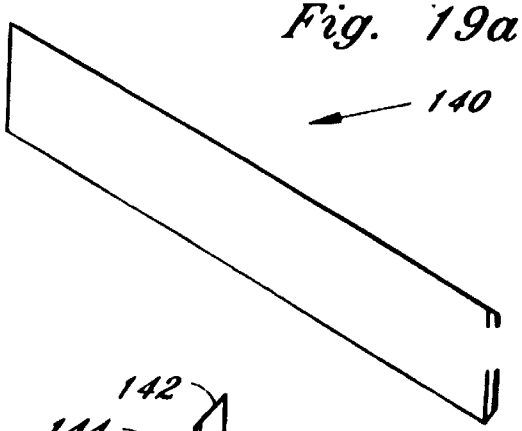
FIG. 19*b* is a perspective rear view of the grout float attachment of the present invention.
Figure 19C:
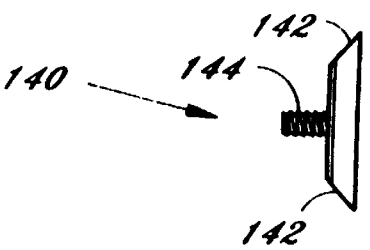
FIG. 19*c* is a side view of the grout float attachment of the present invention.

Once a layer of mortar is spread and tiles are installed thereon, the device 110 is converted to a grout spreader wherein the trowel blade sections 130*a* and 130*b* are removed from mounting plates 120 and at least one downwardly extending grout float 140, as best depicted in FIGS. 19 *a–c*, having a rubber-like straight edge 142, is installed. Grout float 140 includes a back surface having a plurality of threaded fasteners 144 for anchoring float 140 to mounting assembly 120 as best depicted in FIG. 20. In addition, a second downwardly extending grout float 140, may be installed on mounting assembly 122. The second grout float acts as a squeegee and is attached to the trailing end for removing excess grout from the flooring tile surface. The second grout float is in a vertical configuration such that the lower edge 142, functions as a rubber-like squeegee, contacting the underlying tile surface for removing excess grout.

Figure 17:
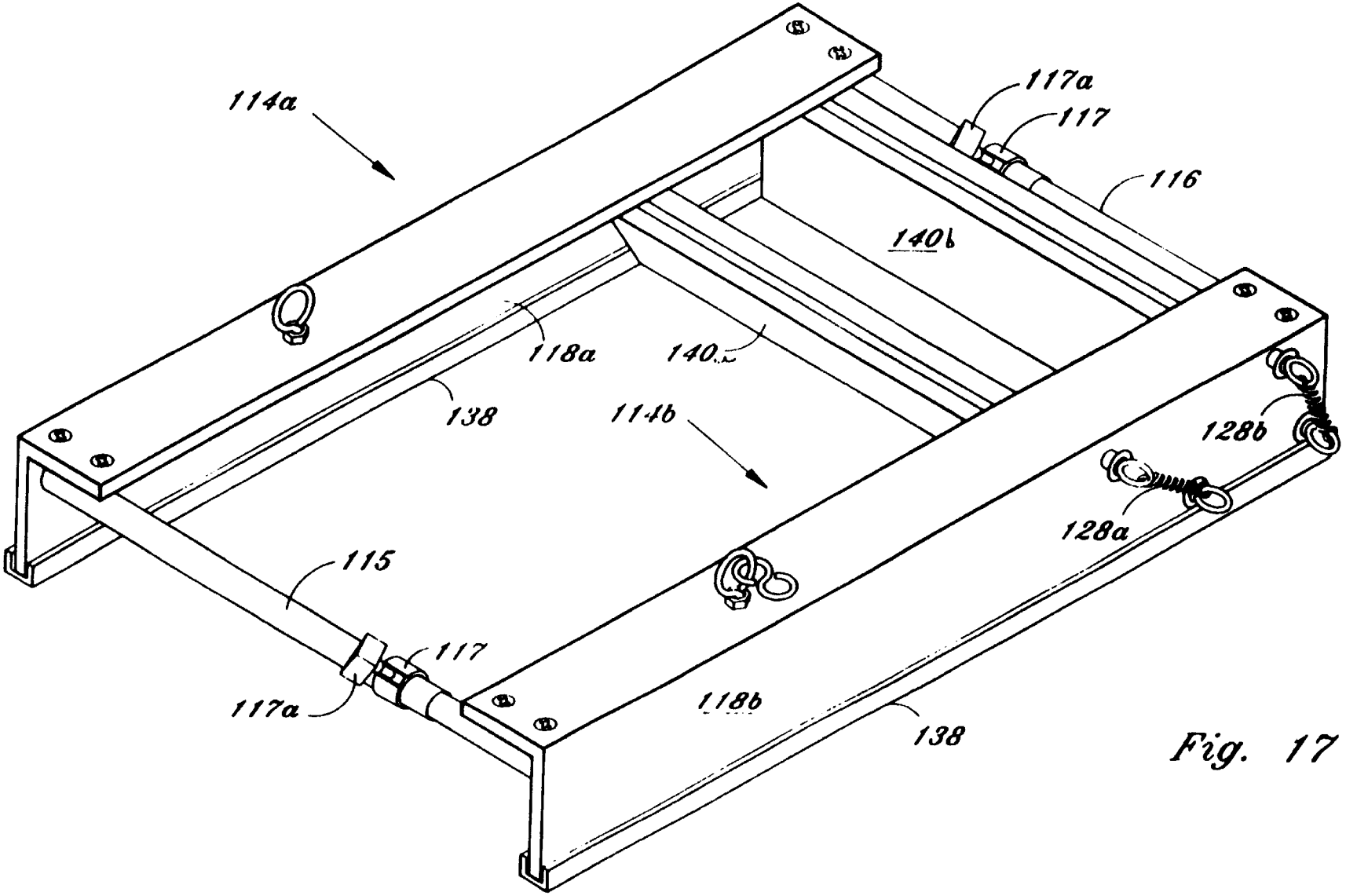
FIG. 17 is a perspective of the improved alternate embodiment of the instant invention with a grout floats attached.
Figure 18:
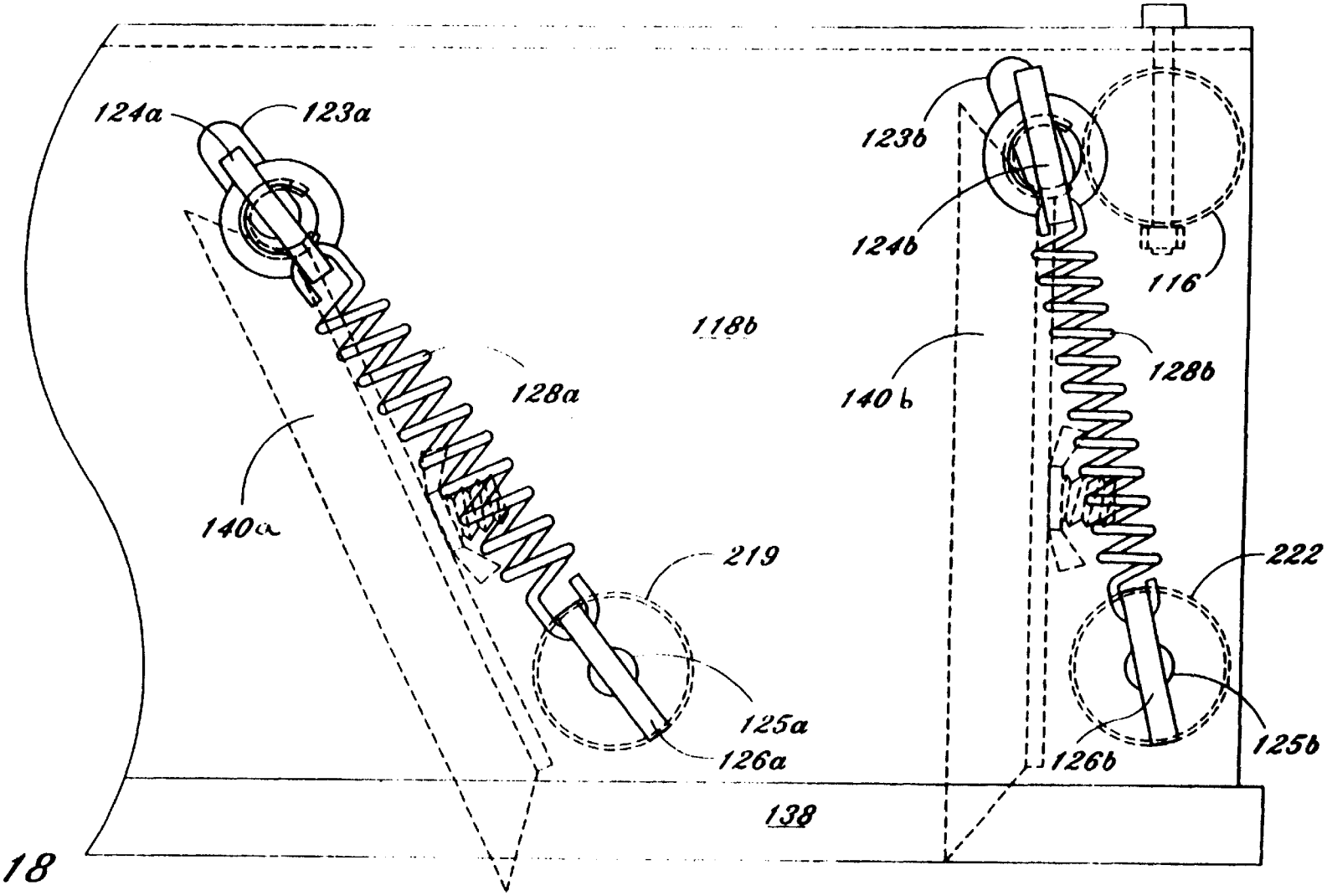
FIG. 18 is a partial side view of the improved alternate embodiment of the instant invention with grout floats attached.

The device 110 is depicted in its grout spreading configuration in FIGS. 17 and 18. It is important to note that springs 128*a* and 128*b*(as well as similar springs on the opposite side of the frame) bias the attached grout floats, referenced as 140*a* and 140*b*, downward and maintain the grout float edges in contact with the underlying tiles. It is also desirable for the leading grout float 140*a* to extend downward at an angle, as depicted in FIG. 18, for forcing the grout into the tile joints, while the second grout float 140*b* is substantially vertically disposed and acts as a squeegee and removes excess grout from the tile gaps and the tile surface thereby completing the grouting process.

In the grout spreading mode the device 110 is positioned over the previously installed flooring tile and a suitable amount of grout is poured in the middle of the frame such that the grout is contained by opposing frame side walls 118*a* and 118*b* and first grout float 140. Once again weights are placed on the trailing end corners and the device is dragged across the flooring tile by the user. A Rope 40 may be attached to eyebolts 150*a* and 150*b* at the frame leading end for enabling the user to easily drag the device across the tile. As the device 10 slides across the underlying tile, the plastic coated skids 38 prevent scratching. The First Grout float 140*a* forces grout into the gaps existing between the tiles, while the second grout float 140*b* removes excess grout thereby completing the grouting process.

The instant invention thus provides a combination mortar and grout spreading device capable of adjusting to various widths and spreading mortar in a uniform straight combed manner as recommended by the guidelines developed by the National Tile Contractors Association.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A combination floor tile bonding material spreading device for spreading floor tile mortar bonding material and grout, said device comprising:

a frame having a leading end, a trailing end, and opposing downwardly extending side walls extending between said leading end and said trailing end, said side walls in spaced relation and defining a frame width, said side walls each defining a slotted aperture, said frame defining an open top and an open bottom;

means for adjusting said frame width;

a pair of telescopically connected mounting plates, each of said mounting plates having an end connected to one of said side walls and movably disposed within one of said slotted apertures, said mounting Plates being resiliently biased downwardly;

spreading hardware removably connected to said mounting plates;

said opposing frame sides for containing a quantity of bonding material placed on the floor therebetween, whereby sliding said frame across said floor causes said spreading hardware to spread material corresponding to said frame width.

2. A device according to claim 1, wherein said spreading hardware comprises a removably attached trowel blade.

3. A device according to claim 1, wherein said spreading hardware comprises a removably attached grout float.

4. A device according to claim 1, further comprising means for anchoring said frame at a predetermined width.

5. A device according to claim 1, wherein said opposing frame sides include non-scratching skids attached to the bottom of each of said frame sides.

6. A combination floor tile mortar and grout spreading device for spreading a layer of floor tile mortar bonding material over an underlying floor, and for applying grout between floor tiles set therein, said device comprising:

a telescopically adjustable frame having a leading end, a trailing end, and opposing downwardly extending side walls extending between said leading end and said trailing end, said side walls in spaced relation and defining a frame width, said frame defining an open top and an open bottom;

each of said side walls defining a first and second slotted apertures;

first and second telescopically adjustable hardware mounting means having opposing ends movably fastened through said slotted apertures, said hardware mounting means disposed in spaced, substantially parallel, relation and extending between said side walls;

resilient means connected to each of said hardware mounting means, said resilient means downwardly biasing each of said hardware mounting means;

said frame side walls for containing a quantity of bonding material placed therebetween, whereby sliding said frame across said floor causes said hardware mounting means to pass over said bonding material.

7. A device according to claim 6, further including a pair of overlapping trowel blades attached to either said first or second hardware mounting means.

8. A device according to claim 6, further including a grout float attached to either said first or second hardware mounting means.

9. A device according to claim 6, further including first and second grout floats attached to said first and second hardware mounting means.

10. A device according to claim 6, wherein said first hardware mounting means is inclined downwardly toward said frame trailing end.

11. A device according to claim 7, wherein said trowel blades each define opposing notched edges.

* * * * *